United States Patent [19]

Rottstedt

[11] Patent Number: 4,570,539

[45] Date of Patent: Feb. 18, 1986

[54] METHOD OF ADJUSTING THE INKING UNIT OF A PRINTING MACHINE AND A MEASURING DEVICE FOR PERFORMING THE SAME

[75] Inventor: Hans-Jürgen Rottstedt, Heusenstamm, Fed. Rep. of Germany

[73] Assignee: M.A.N.-Roland Druckmaschinen Aktiengesellschaft, Fed. Rep. of Germany

[21] Appl. No.: 646,260

[22] Filed: Aug. 30, 1984

[30] Foreign Application Priority Data

Aug. 30, 1983 [DE] Fed. Rep. of Germany ..... 3331208

[51] Int. Cl.[4] ..... B41F 31/04; B41F 31/10; B41L 27/16

[52] U.S. Cl. ..... 101/426; 101/365; 101/DIG. 25; 101/DIG. 26

[58] Field of Search ..... 101/365, 350, 207–210, 101/211, 426, DIG. 24, DIG. 26, DIG. 6

[56] References Cited

U.S. PATENT DOCUMENTS

| | | | |
|---|---|---|---|
| 3,353,484 | 11/1967 | Koyak | 101/350 |
| 3,707,123 | 12/1972 | Heasman et al. | 101/207 |
| 3,746,957 | 7/1973 | Forster | 318/696 |
| 3,756,725 | 9/1973 | Manring | 356/195 |
| 3,908,545 | 9/1975 | Simeth | 101/350 |
| 3,930,447 | 1/1976 | Murray | 101/365 |
| 3,958,509 | 5/1976 | Murray et al. | 101/365 |
| 3,978,788 | 9/1976 | Cappel et al. | 101/363 |
| 4,151,796 | 5/1979 | Uhrig | 101/142 |
| 4,193,345 | 3/1980 | Schoneberger | 101/365 |
| 4,200,932 | 4/1980 | Schramm et al. | 364/519 |
| 4,428,287 | 1/1984 | Greiner | 101/170 |

FOREIGN PATENT DOCUMENTS

| | | |
|---|---|---|
| 2412234 | 10/1975 | Fed. Rep. of Germany . |
| 2080201 | 2/1982 | United Kingdom . |

*Primary Examiner*—J. Reed Fisher

*Attorney, Agent, or Firm*—Leydig, Voit & Mayer, Ltd.

[57] ABSTRACT

The ink dosing elements in the ink fountain of a printing machine are adjusted to reference positions in response to measurement of the amount of ink applied to the fountain roller at the respective inking zones. The reference positions are stored in a data memory for future use or are adjusted in accordance with predetermined values to arrive at the settings of the ink dosing elements for obtaining a desired ink profile. Preferably an optical densitometer mounted on a rail parallel to the fountain roller measures the amount of ink, and the densitometer is initially calibrated at an ink-free zone on the fountain roller. According to a manual embodiment, a first one of the ink dosing elements is brought to a reference position by an operator while viewing the respective inking zone, for example, to obtain a permissible minimum of ink. The densitometer is moved to measure the ink at the first inking zone, and is successively moved to measure the ink at the other inking zones while the respective ink dosing elements are adjusted to obtain substantially the same measured values for all of the inking zones. Alternatively, the method is performed by a remote control computer.

3 Claims, 7 Drawing Figures

METHOD OF ADJUSTING THE INKING UNIT OF A PRINTING MACHINE AND A MEASURING DEVICE FOR PERFORMING THE SAME

BACKGROUND OF THE INVENTION

1. Field of the Invention

The invention relates to a method of adjusting the inking unit of a printing machine comprising a plurality of ink dosing elements, whose distances from a fountain roller are adjustable independently of one another.

2. Description of the Related Art

Inking units typically have an ink fountain and a plurality of independently adjustable ink dosing or dispensing elements of the kind disclosed, for example, in Cappel et al. U.S. Pat. No. 3,978,788 issued Sept. 7, 1976. The ink dosing elements must be brought into reference or standand zero positions with respect to an ink fountain roller before a specific ink profile is set up on the fountain roller. At these reference positions all of the ink dosing elements are at the same distance from the fountain roller. The distance determines the amount of ink dispensed by the ink dosing elements. Only when the reference positions have been obtained is it possible for a specific ink profile required for a given print to be obtianed or reproduced based on predetermined values.

The reference positions obtained by prior methods have been influenced by various operating parameters such as operating temperature, bearing clearance, and mechanical deformation of individual components. It has been necessary to rely on eyesight to find the reference positions giving rise to uniform ink application. But this procedure is very time-consuming and requires an operator having considerable experience and skill.

SUMMARY OF THE INVENTION

The primary object of the invention is to provide a method for adjusting the inking unit of a printing machine which is reliable, rapid, and requires little or no participation by the printing machine operator.

To this end, according to the primary aspect of the invention, a first ink dosing element is brought into a reference position and the ink applied to the fountain roller is measured in the first inking zone adjusted by the first ink dosing element; the ink applied to the fountain roller is measured in the same way in the other inking zones; and the other ink dosing elements are adjusted until the ink applied in all the inking zones corresponds to the value measured in the first inking zone. This method according to the invention has the advantage that the ink dosing elements of the inking unit of a printing machine can be rapidly and reliably brought into uniform references or zero positions without the need for the human eye. As soon as a first ink dosing element has been manually or otherwise brought to a reference position, it is possible to bring automatically all the other elements into corresponding positions. Since the correct positions of the ink dosing elements are determined only by the ink applied to the fountain roller in this adjustment method according to the invention, there are no adjustment errors due to disturbing operating variables, such as fountain roller deflection or fountain roller elongation on heating.

According to another aspect of the invention, the ink applied to the fountain roller is measured by light-dark sensing. The advantage of this measurement that is extremely thin ink films of a few μm can be detected. A densitometer is preferably used for the light-dark sensing.

According to another aspect of the invention, one very simple procedure is to sense the fountain roller by ink zones using a measuring device. It is advantageous to calibrate the measuring device on an ink-free calibration zone before measuring the ink zones. The calibration zone is preferably an ink-free area of the duct roller. The measurements found are then comparable with other measurements. Also the first reference position can be determined by measurement and if necessary adjusted by means of the measuring device.

In another advantageous embodiment of the invention, the reference positions of the ink dosing elements are measured with respect to the duct or frame of the ink fountain and the measured values are stored in a data memory. The ink dosing elements can then always be returned to the reference positions once they have been found, without any need for remeasuring the ink application. Each reference position can be obtained by adjusting the entire arrangement consisting of the respective ink dosing element together with its adjusting device and position measuring device, for example, a cam and a potentiometer. Alternatively, the reference position can be obtained by actuating the adjusting device if the characteristic of the adjusting device is allowed for in calculating the new adjustment paths. This is necessary when the dispensing elements are adjusted in accordance with a non-linear characteristic.

According to still another aspect of the invention, a preferred measuring device is used having the sensing head of a densitometer movable on a rail substantially parallel to the fountain roller and a facility for indexing or locking the sensing head in the region of each ink zone.

BRIEF DESCRIPTION OF THE DRAWINGS

Other objects and advantages of the invention will become apparent upon reading the attached detailed description and upon reference to the drawings in which.

While the invention has been described in connection with certain preferred embodiments, it will be understood that there is no intention to limit the invention to the embodiments shown, but it is intended, on the contrary, to cover the various alternative and equivalent constructions included within the spirit and scope of the appended claims.

DESCRIPTION OF THE PREFERRED EMBODIMENTS

Figure 1:
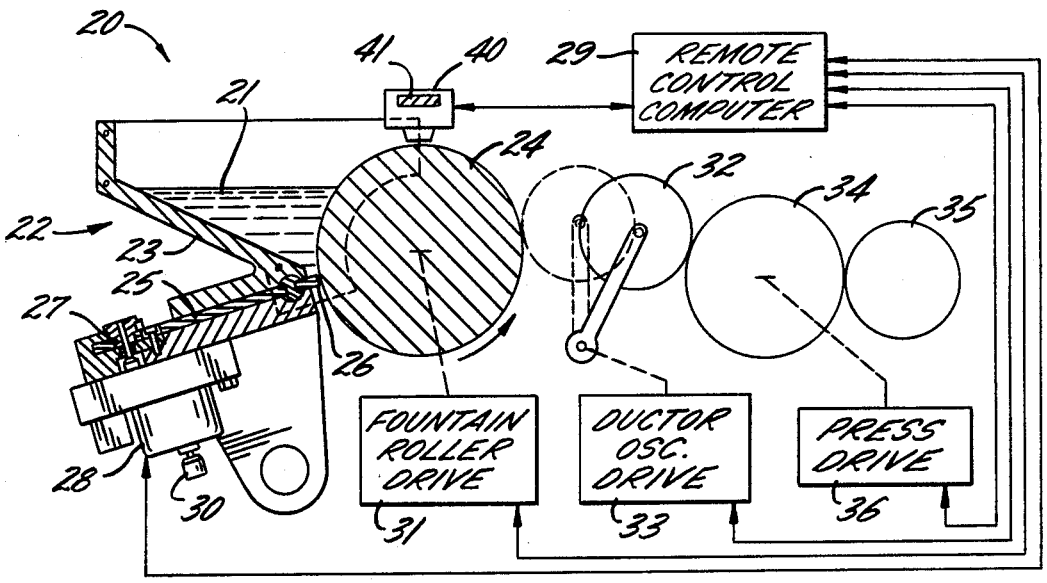
FIG. 1 is a block diagram of a preferred embodiment of the invention using a remote control computer and showing the ink fountain and densitometer in cross section.

Turning now to the drawings, there is shown in FIG. 1 the inking unit generally designated 20 of a printing machine. Ink 21 is stored in the trough of an ink fountain generally designated 22 comprising a frame 23 abutting against a rotating fountain roller 24. In order to regulate the amount of ink applied to the fountain roller 24, a plurality of ink dosing elements 25 in the form of flat valves are mounted in slides in the frame 23 and abut against the surface of the fountain roller 24. In other words, an ink duct 26 is formed by the gap between the ink dosing elements 25 and the surface of the fountain roller 24 which permits a precisely regulated film of ink to be transferred to the surface of the fountain roller. To adjust this gap and thereby regulate the amount of ink, the positions of the ink dosing elements 25 with respect to the fountain roller 24 are adjusted by eccentric cams 27, which are in turn rotated by stepping motors 28 through suitable gear trains. The ink fountain 22 is further described in Cappel et al. U.S. Pat. No. 3,978,788 issued Sept. 7, 1976.

The ink dosing elements 25 are preferably adjusted by a remote control computer generally designated 29. Computerized remote controls for adjusting the ink dosing elements 25 are sold by all of the major printing machine manufactures. A suitable system is described, for example, in Schramm et al. U.S. Pat. No. 4,200,932 issued Apr. 29, 1980. When a stepping motor 28 is used, the remote control computer 29 can measure the position of the ink dosing element 25 with respect to the frame 23 by counting the number of steps that the motor 28 has driven the ink dosing element toward or away from the fountain roller 24. The motor 28 also has a knob 30 on the motor shaft to permit a manual resetting of the ink key position.

In order to convey ink from the ink fountain 22 to the rest of the printing machine, the ink fountain roller 24 is rotated by a fountain roller drive 31 so that the regulated film of ink is distributed over the entire surface of the fountain roller 24. A pivoted ductor roller 32 is periodically driven by a ductor oscillator drive 33 into contact with the fountain roller 24 to pick up the ink film on the surface of the fountain roller. The ink picked up by the ductor roller 32 is successively transferred to an ink drum 34 and transferred to other rollers such as roller 35 in the printing machine which are driven by the press drive 36 of the printing machine. The operation of the ductor 32 is further described in Simeth U.S. Pat. No. 3,908,545 issued Sept. 30, 1975.

It should be noted that in the inking unit 20 of FIG. 1, the remote control computer 29 does not directly sense the gap between the ink dosing elements 25 and the fountain roller 24. The remote control computer 29 does, however, know the position of the ink dosing element 25 with respect to the ink fountain frame 23, but the position the ink fountain frame 23 with respect to the fountain roller 24 may change from time to time due to differential thermal expansion or wear of the ink dosing elements 25 or the fountain roller 24, as well as loading or wear of the ink fountain roller bearings (not shown). In order for the remote control computer 29 to set a desired ink profile, the ink dosing elements 25 must first be moved, for example, manually by manipulation of the knobs 30, to initial or reference positions. The remote control computer 29 can then displace the ink dosing elements 25 by predetermined amounts to set the desired ink profile. When the ink dosing elements 25 are in their reference positions, for example, the gap between the ink dosing elements and the fountain roller is at a minimum.

Figure 2:
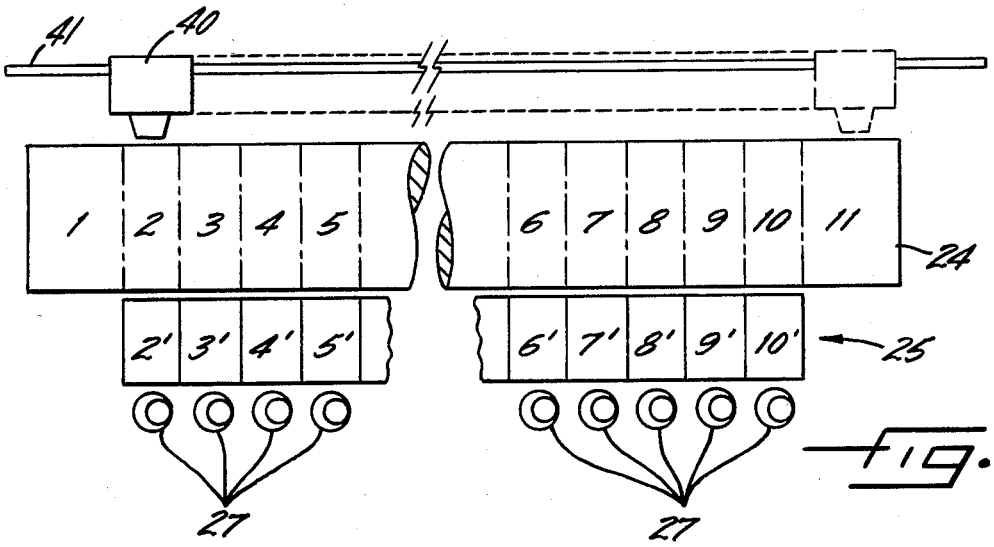
FIG. 2 is a highly schematic top view of the ink fountain shown in FIG. 1 and depicts the ink free zones and inking zones along the length of the fountain roller.

In accordance with a primary aspect of the invention, the ink dosing elements 25 are adjusted to reference positions in response to measurement of the amount of ink applied to the fountain roller 24 at the respective inking zones. Turning now to FIG. 2, the fountain roller 24 is divided along its length into a number of zones such as the zones 1–11. The end zones 1 and 11 are ink-free zones and the intermediate zones 2–10 are inking zones. The inking zones 2–10 correspond to respective ones of the ink dosing elements 25 which are individually designated 2′–10′.

To measure the amount of ink applied to the fountain roller at the respective inking zones, the scanning head 40 of an optical densitometer is mounted on a rail 41 that is substantially parallel to the fountain roller 24. The scanning head 40 is adapted to be moved as required along the fountain roller 24 as shown by the dotted lines. The ink-free zone 11 is shown being used for calibration of the densitometer.

According to one method of the invention, the ink dosing elements 2′–10′ are adjusted as follows:

The densitometer is first calibrated by bringing the sensing head 40 into the broken-line position above the ink-free zone 11 and adjusting the densitometer to register a predetermined maximum light intensity.

Next, the ink adjusting device or cam 27 for a first ink dosing element such as element 2′ is adjusted by eye so that a slight application of ink is just detectable in the entire ink zone 2 on the fountain roller 24. During this adjustment, the fountain roller drive 31 is turned on but preferably the ductor oscillator drive 33 is turned off and the ductor 32 is disengaged from the fountain roller 24. The film of ink during the adjustment of the first ink dosing element 2′ should be at least 3–5$\mu$ in order to prevent the fountain roller from running dry. The sensing head 41 is then moved across the ink zone 2 and the density of the ink film is measured. The measurement X of light intensity indicated by the densitometer, in relation to the maximum calibrated value of intensity, corresponds to the reference position to which the ink dosing element 2′ has been set, and thus forms the guide value for adjusting the other ink dosing elements 3–10 to their corresponding reference positions. To this end, the next operation is to move the sensing head 40 into the region of the ink zone 3 and then to adjust the ink dosing element 3′ by means of the adjusting device 27 until the densitometer again indicates the value X. The same operation is then repeated in the ink zone 4 corresponding to the ink metering element 4′ and so on until all of the ink dosing elements have been adjusted and the value X is measured in all of the inking zones.

In the reference or zero position that has now been set up, all of the ink dispensing elements 2′–10′ are at the same distance from the fountain roller 24, but due to the inking unit component manufacturing tolerances, fountain roller deflection, different bearing clearances, and other influences, the positions of the elements 2′–10′ and their associated adjusting devices 27 with respect to the ink fountain frame 23 usually differ from one element to another. These different positions of the elements are measured, for example, by counting steps of the stepping motors 28 or by means of potentiometers disposed on the adjusting devices 27, and the measured positions are stored in the memory of the remote control computer 29 or stored on punch tape. The ink dosing elements 2'-10' can again automatically be brought to their reference positions by means of these stored values without fresh densitometer measurement being necessary.

From their reference positions set up as described above, the ink dosing elements 2'-10' can be adjusted in accordance with predetermined values in order to form an ink profile suitable for a particular printing run. In the case of electrically remote-controlled inking units, this adjustment can be carried out on the basis of the stored reference values. These stored reference values then form the basis for any readjustments required of the individual ink zones. The stored reference values can also be taken as a basis for setting up new ink profiles so that there is no need for frequent re-measurement of the reference positions of the ink dosing elements.

The reference positions selected will generally be the positions of the ink dosing elements in which the ink applied to the fountain roller 24 just reaches a permissible minimum. When an ink profile is set up, therefore, the reference positions represent a maximum permissible approach of the ink dosing elements 25 to the duct roller 24. It may be advantageous, for reasons associated with monitoring technology, to select reference position in which the ink applied exceeds the permissible minimum, if, for example, this greater amount of ink then allows a more accurate comparative measurement between the individual inking zones. When setting an ink profile, a check will then have to be made to determine the amount by which the ink dosing elements should be brought nearer the fountain roller beyond this more distant reference position.

Figure 3:
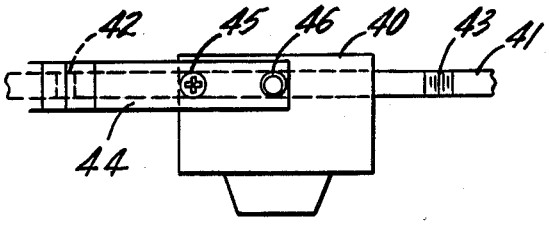
FIG. 3 is a side view of the densitometer head incorporating an indexing mechanism for locking the sensing head in the region of each ink zone.
Figure 4:
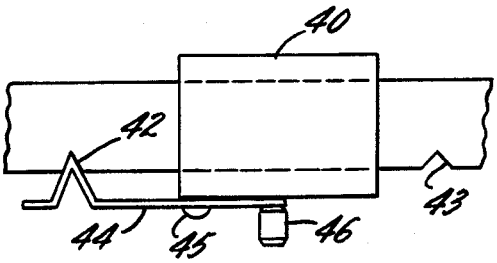
FIG. 4 is a top view of the sensing head and indexing mechanism shown in FIG. 3.

When the method of the present invention is performed manually, it is advantageous to use a locating mechanism for indexing the sensing head 40 of the densitometer. As shown in FIGS. 3 and 4, the rail 41 includes periodically spaced notches such as notches 42 and 43 for indexing the sensing head 40 at predefined respective positions along the rail 41 for aligning the sensing head with the respective inking zones 2-10. In other words, one notch is provided for each inking zone. The notches 42, 43 receive a flat spring 44 which is screwed to the body of the sensing head 40 via a machine screw 45 and a knob 46.

Figure 5:
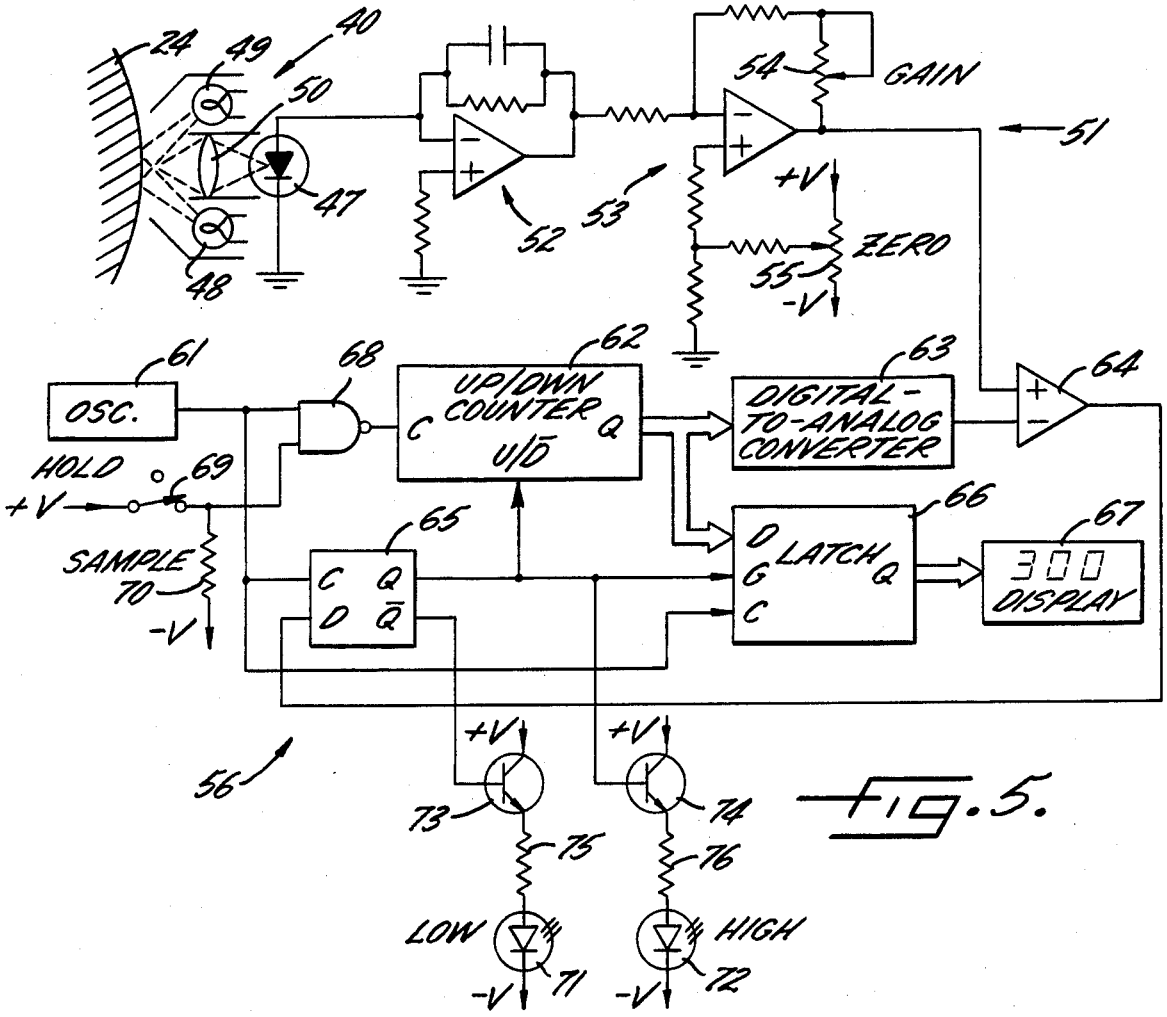
FIG. 5 is a schematic diagram of the densitometer circuits and a modified tracking analog-to-digital converter used in the manual method of the present invention.

Turning now to FIG. 5 there are shown electrical circuits for the densitometer and for a tracking analog-to-digital converter which is modified to store the measurement X for the first inking zone 2 and for comparing the stored value X to the measured values for the other inking zones 3-10. In order to measure the density of ink film on the fountain roller 24, the sensing head 40 of the optical densitometer includes a photo diode 47 responsive to light reflected from the surface of the fountain roller 24. The fountain roller 24 is illuminated, for example, by incandescent lamps 48, 49 and the reflected light is focused on the photo diode 47 by a lens 50. The signal from the photo diode 47 is amplified by an amplifier generally designated 51 including a preamplifier stage 52 and an output amplifier stage 53 which includes substantially independent gain and zero controls 54, 55, respectively. The zero control 55 is adjusted to obtain a substantially zero voltage output from the amplifier 51 when the illumination of the diode 47 is substantially zero as is obtained, for example, for a thick ink film on the fountain roller 24. The gain control 54 is adjusted to obtain a predetermined maximum or full scale value when the fountain roller 24 is free of ink and substantially reflects all of the light from the incandescent lamps 48, 49 to the photo diode 47. The gain control 54 is adjusted, for example, during the calibration of the scanning head 40, when the scanning head is at one of the ink free zones 1, 11.

In order to measure the ink density when the first ink dosing element 2' is adjusted to a reference position and to later compare the measured value X to the values measured at the other inking zones 3-10, the voltage output of the amplifier 51 is fed to a tracking type analog-to-digital converter generally designated 56. As is well known, a tracking digital-to-analog converter includes an oscillator 61, a synchronous up/down counter 62, a digital-to-analog converter 63, a comparator 64, a D type or sampling flip-flop 65, and a latch 66. The comparator 64 compares the analog voltage to be converted to an analog voltage generated by the digital-to-analog converter 63 responsive to the numerical state of the up/down counter 62. If the output of the comparator 64 is logically high, indicating that the numerical value of the up/down counter is lower than the correct value, the up/down counter is successively incremented in step with the clocking signal from the oscillator 61. If the output of the comparator 64 is logically low, indicating that the numerical value of the up/down counter is higher than the desired value, then the up/down counter is decremented in response to the clocking signal from the oscillator 61. A latch 66 strobed when the up/down counter is about to count upwardly, provides a stable indication of the numerical state in the up/down counter in order todrive a digital display 67. To simplify decoding, the display 67 indicates, for example, eight bits stored in the latch 66 as a three digit octal number ranging from 000 to 377. During an initial calibration, the zero control 55 is adjusted when the incandenscent lamps 48, 49 are turned off in order to obtain a minimum intensity value of 100. During calibration on an ink-free zone 1 or 11 with the incandescent lamps 48, 49 turned on, the gain control 54 is adjusted to obtain a maximum or full scale value of 300. Next, after the scanning head 40 has been moved to the first inking zone 2 and the ink dosing element 2' has been adjusted via the respective adjusting mechanism 27 to the point where an ink film has just been detected, th analog-to-digital converter 56 is inhibited to sample and store the measured value for the first inking zone 2. For this purpose, a NAND gate 68 disables the clocking signal from the oscillator 61 from reaching the clock input of the up/down counter 62 when the operator switches a sample/hold switch 69 to an open position, so that a load resistor 70 applies an inhibit signal to the gate 68. It should be noted that the technique of inhibiting a tracking type analog-to-digital converter was disclosed in Ebling et al. U.S. Pat. No. 4,098,274 issued July 4, 1978.

Next the densitometer head 40 is successively moved to scan the other inking zones 3-10 and the respective ink dosing elements 3'-10' are adjusted by the respective adjusting devices 27 until the measured values agree with the stored measured value X indicated on the display 57. In order to indicate whether the measured value is lower or higher than the stored value X, the Q and Q complement outputs of the flip-flop 55 are indicated by respective light emitting diodes 71 and 72, driven by respective emitter followers 73 and 74 having load resistors 75 and 76.

The manual operations just described above can be performed entirely by the remote control computer 29. The use of a remote control computer to drive a densitometer along a rail and to adjust ink dosing elements is described, for example, in Greiner U.S. Pat. No. 4,428,287 issued Jan. 31, 1984. The scanning head 40 of the optical densitometer is driven, for example, by a stepping motor 80 in the conventional manner as is used, for example, in XY plotters and in dot-matrix impact printers. The stepper motor 80 is driven by a multi-phase oscillator or clock such as the two-phase clock 81 shown in FIG. 6. A phase selector switch 82 operated by the remote control computer 29 determines whether the motor 70 is driven forward or reverse and the remote control computer 29 can also stop the motor 70 by turning off the motor driver circuits 83. The remote control computer 29 knows the position of the scanning head 40 with respect to the fountain roller 24 by counting the number of forward or reverse pulses applied to the stepping motor 80 after the scanning head 40 is driven to left or right limit switches 84, 85 placed at the ends of the rail 41.

The remote control computer 29 receives the output of the analog-to-digital converter 56 by reading the output of the latch 66 (FIG. 5) which is gated by a periodic data strobe such as a phase of the oscillator 81, instead of being gated as shown in FIG. 5. The analog-to-digital converter 56, in other words, operates continuously and the remote control computer itself remembers the measured value for the first inking zone. The remote control computer 29 can also control the fountain roller, ductor and press drives 86, and the ink key servos 28. The remote control computer 29 can also receive ink key set-up values 87 from the machine operator or user, and can store the set-up values as well as the reference values in non-volatile memory 88 for future use.

Figure 6:
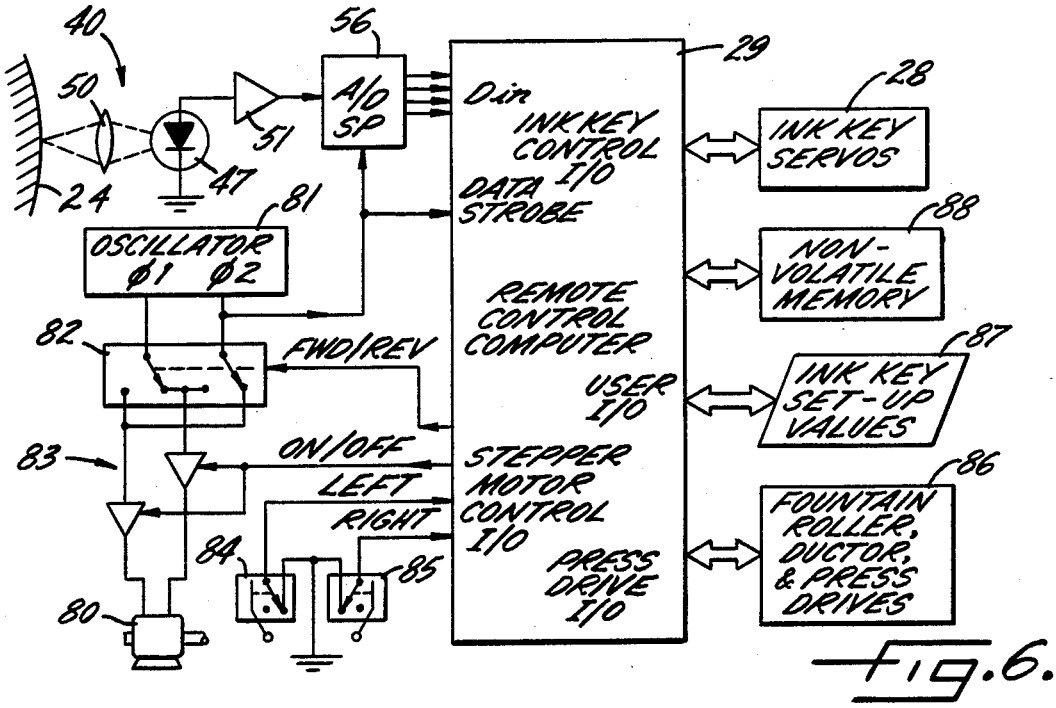
FIG 6. is a schematic diagram of the remote control computer and its associated circuits for performing the automatic method of the present invention.
Figure 7:
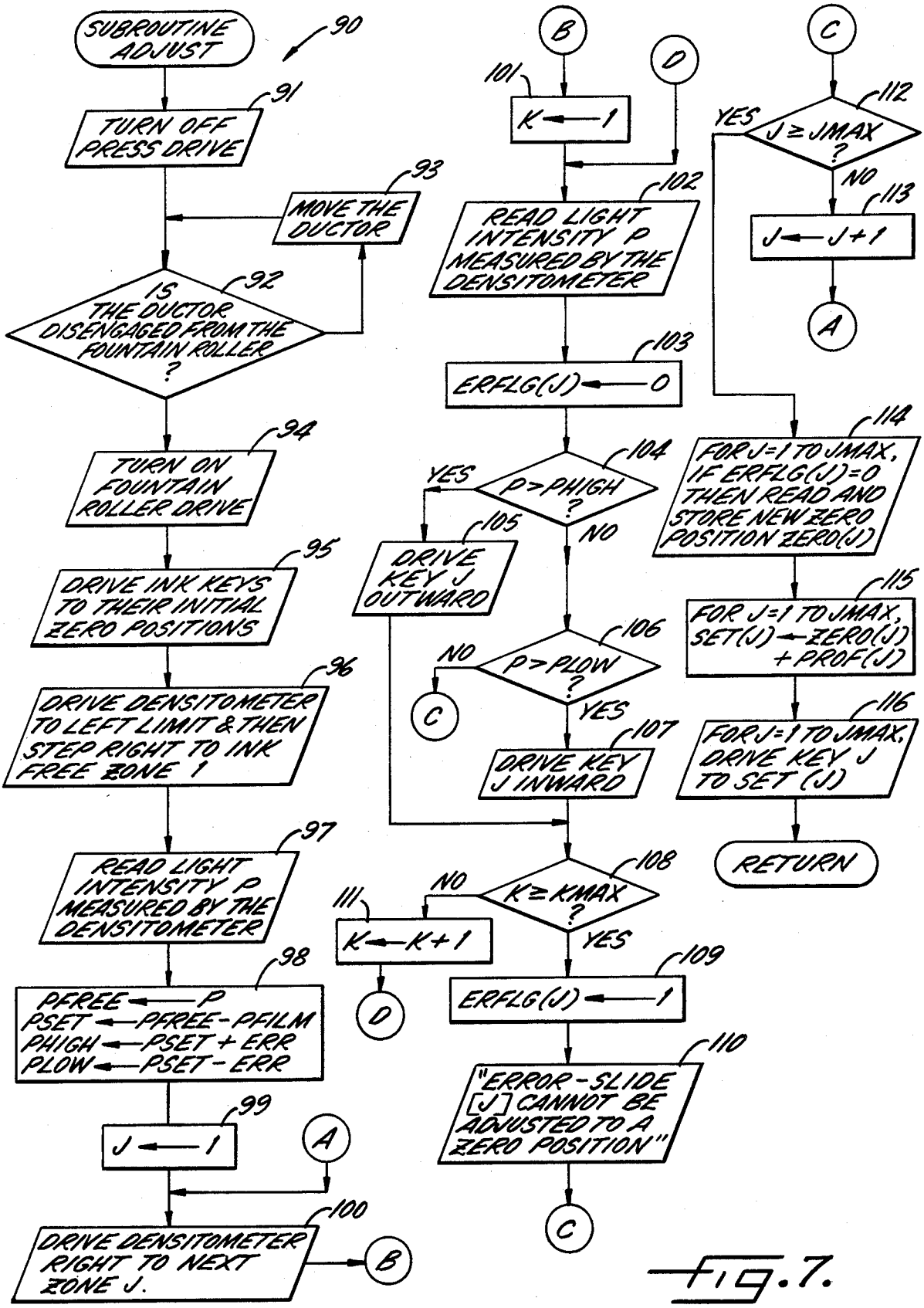
FIG. 7 is a flowchart of a subroutine executed by the remote control computer shown in FIG. 6 for performing the automatic method of the present invention.

The remote control computer 29 as shown in FIG. 6 can automatically perform the method according to the invention without the aid of the human eye. For this purpose, the remote control computer executes a procedure such as is shown in the flow chart of FIG. 7. The procedure is invoked by calling the subroutine ADJUST generally designated 90. In the first step 91 the remote control computer 29 turns off the press drive (36 FIG. 1). Next, in step 92 the position of the ductor roller 32 is sensed to determine whether the ductor is disengaged from the fountain roller 24. If the ductor is not disengaged from the fountain roller, then in step 93 the ductor is moved until it is disengaged from the fountain roller. Then in step 94 the fountain roller drive 31 is turned on and in step 95 the ink dosing elements or ink keys 25 are driven to initial zero positions having been stored in non-volatile memory 88 from the previous operation of the printing machine.

To calibrate the densitometer, in step 96 the scanning head 40 is driven to the left limit switch 84 and is then stepped right to scan the ink-free zone 1. In step 97 the remote control computer 29 reads the light intensity P measured by the densitometer and sampled by the analog-to-digital converter 56. In step 98, the calibration is completed by calculating set points PHIGH and PLOW defining the tolerable limits on the desired optical intensity measured at all of the inking zones 2–10 once the ink dosing elements 2'–10' have been adjusted to their reference positions. A set point PSET is first calculated as the difference between the optical intensity PFREE measured in the ink-free zone 1 and a predetermined value PFILM responsive to the desired thickness of the ink film when the ink dosing elements 2'–10' are adjusted to the reference positions. The value PFILM is determined, for example, by a single manual adjustment using the manual procedure described above in conjunction with FIG. 5. The set point PSET corresponds to the measured value X. The threshold values PHIGH and PLOW are obtained by adding and subtracting, respectively, a small error value PERR from the set point PSET. The thresholds PHIGH and PLOW are used to prevent hunting when attempting to achieve the set point PSET and to detect and indicate an error when the adjustment procedure cannot obtain a measured value within the thresholds.

Iterative adjustment of the ink dosing elements is started in step 99 by setting an iteration index J to one. In step 100 the scanning head 40 of the densitometer is driven right to the next zone. Then in step 101 a counter K is set to one. The counter K is used to register the number of steps of the servo motor 28 that are tried in order for the measured value to approach the set point PSET. In step 102 the remote control computer 29 reads the light intensity P measured by the densitometer and sampled by the analog-to-digital converter 56. In step 103, the $J_{th}$ element of an error flag array ERFLG is set to zero. In step 104 the light intensity P is compared to the high threshold PHIGH. If the intensity P exceeds the high threshold PHIGH, then in step 105 the $J_{th}$ ink dosing element 25 is moved outwardly from the fountain roller 24 by stepping the servo motor 28. If the optical intensity P is not greater than the high threshold PHIGH, then in step 106 the optical intensity P is compared to the low threshold PLOW. If the optical intensity P is found in step 106 not to be less than the low threshold PLOW, then the $J_{th}$ ink dosing element 25 has been properly adjusted. Otherwise, then in step 107, the $J_{th}$ ink dosing element is moved inwardly with respect to the fountain roller 24 by stepping the servo motor 28. After stepping the servo motor in step 105 or 107, then in step 108 the counter K is compared to a predtermined maximum KMAX. If the counter K reached the maximum KMAX, then it is presumed that the $J_{th}$ ink dosing element 25 cannot be properly adjusted, and the $J_{th}$ element of the error flag array ERFLG is set to one in step 109 to flag the error. An error message is also displayed to the user in step 110. If, however, in step 108 the counter K was found to be less than the maximum KMAX, then in step 111 the counter K is incremented and another adjustment cycle is performed starting with step 102.

After proper adjustment of the $J_{th}$ ink dosing element is detected in step 106, or adjustment of the $J_{th}$ ink dosing element was found to be impossible, as indicated in step 110, then in step 112 the index J is compared to a predetermined maximum JMAX denoting the number of ink dosing elements 25 in the inking unit 20. If the index J is less than the maximum JMAX, then in step 113 the index J is incremented and execution returns to step 100 to begin the adjustment process for the next ink dosing element. If, however, in step 112 the index J reaches the maximum JMAX, then all of the ink dosing elements 25 have been adjusted to their respective reference positions unless an error is indicated in the error flag array ERFLG. Therefore, in step 114, for each ink dosing element that has been readjusted to the desired reference position, the new reference position is stored in non-volatile memory (88 FIG. 6) in an array ZERO. Then, in step 115, the set points for a desired ink profile are calculated by adding the respective reference values, stored in the non-volatile memory 88, to respective predetermined values having been previously stored in non-volatile memory in an array PROF after having been received from the user as set-up values (87 FIG. 6). Finally, in step 116, the ink dosing elements are driven to positions corresponding to the set point values calculated in step 115.

In view of the above, a method for adjusting the ink dosing elements in a printing machine to reference positions has been described that is reliable, rapid and requires little or no participation from the printing machine operator. The method is easily performed by a printing machine operator using an optical densitometer head mounted to the inking unit of the printing machine and operating in conjunction with a modified tracking analog-to-digital converter. Moreover, by providing a stepping motor and limit switches for automatic positioning of the densitometer head, and by executing a procedure as described in FIG. 7 in a remote control computer, the ink dosing elements are adjusted to reference positions without manual intervention and without the use of the human eye.

What is claimed is:

1. A method of adjusting the inking unit of a printing machine having a plurality of ink dosing elements disposed along the length of an ink fountain roller, means for adjusting the distances of the ink dosing elements from the fountain roller independently of one another to thereby regulate the amount of ink applied to a plurality of inking zones along the length of the fountain roller corresponding to respective ones of the ink dosing elements, and an optical densitometer having a sensing head for measuring by light-dark sensing the amount of ink applied to the fountain roller, the optical densitometer being slidably mounted on a rail mounted substantially parallel to the fountain roller, said method comprising the steps of:

(a) manually positioning the densitometer so that its sensing head is aligned with an ink-free zone of the fountain roller and using the measured response of the densitometer for calibration by adjusting the densitometer to register a predetermined maximum light intensity, (b) bringing a first one of said ink dosing elements to a reference position with respect to said fountain roller by manually adjusting said first ink dosing element so that a slight application of ink is just detectable by the human eye in the entire inking zone regulated by said first ink dosing element, (c) manually positioning the densitometer to a first one of the inking zones regulated by said first ink dosing element and using a locating mechanism engaging said rail at periodically spaced positions along said rail corresponding to the inking zones including a position along said rail corresponding to the first inking zone for aligning the sensing head with the first inking zone, (d) obtaining the densitometer measurement for the amount of ink applied to said fountain roller at the first inking zone, (e) successively and manually positioning the densitometer to each of the other of said inking zones and using said locating mechanism engaging the rail at corresponding positions for aligning the sensing head with each of the other of said inking zones, obtaining densitometer measurements and adjusting each of the other ink dosing elements until the measured amount of ink applied to the fountain roller at the other of said inking zones corresponds to the measured amount of ink applied to the fountain roller at the first one of said inking zones, so that said ink dosing elements are adjusted to corresponding reference positions, and (f) adjusting the ink dosing elements by respective predetermined amounts from the reference positions obtained in steps (b) and (e), in order to obtain a desired ink profile.

2. The method as claimed in claim 1, wherein the ink dosing elements are adjusted by the predetermined amounts in step (f) by measuring the reference positions of the ink dosing elements obtained in steps (b) and (e) and storing the measured values of the reference positions in a data memory, reading the stored reference values from said data memory, offsetting the reference values read from said data memory by respective predetermined values, and moving the ink dosing elements to positions indicated by the offset reference values, so that a desired ink profile is obtained.

3. A method of adjusting the inking unit of a printing machine having a plurality of ink dosing elements disposed along the length of an ink fountain roller and means for adjusting the distances of the ink dosing elements from the fountain roller independently of one another to thereby regulate the amount of ink applied to a plurality of inking zones along the length of the fountain roller corresponding to respective ones of the ink dosing elements, said fountain roller also having at least one ink-free zone, said method comprising the steps of:

(a) traversing the sensing head of an optical densitometer along a rail mounted substantially parallel to the axis of the fountain roller to align the sensing head with said ink-free zone of said fountain roller, (b) measuring the response of the optical densitometer to the ink-free zone to obtain an ink-free measured value, (c) moving the sensing head of the optical densitometer along the rail to align the sensing head with a first one of said inking zones, (d) adjusting the ink dosing element corresponding to said first inking zone to obtain a response X from said densitometer differing from the ink-free measured value by a predetermined value responsive to the thickness of the ink film applied to the first inking zone by the corresponding ink dosing element, (e) successively moving the sensing head of the optical densitometer along the rail to align the sensing head with the other of said inking zones, and adjusting the respective ink dosing elements to obtain responses of approximately X from the optical densitometer for each inking zone, so that said ink dosing elements are adjusted to corresponding reference positions, (f) measuring said reference positions of the ink dosing elements obtained after steps (a), (b), (c), (d) and (e) and storing the measured values of the reference positions in a data memory, (g) reading the stored reference values from said data memory, (h) offsetting the reference values read from said data memory by respective predetermined values, and (i) moving the ink dosing elements to positions indicated by the offset reference values, so that a desired ink profile is obtained.

* * * * *